United States Patent [19]

Nowak

[11] 4,291,641

[45] Sep. 29, 1981

[54] LIQUID DISPENSING APPARATUS

[75] Inventor: Herman P. Nowak, Danvers, Mass.

[73] Assignee: The Gillette Company, Boston, Mass.

[21] Appl. No.: 106,194

[22] Filed: Dec. 21, 1979

[51] Int. Cl.[3] ..... B05C 7/00

[52] U.S. Cl. ..... 118/408; 118/DIG. 10; 222/522

[58] Field of Search ..... 118/408, 243, 263, 254; 141/89; 222/389, 522, 537

[56] References Cited

U.S. PATENT DOCUMENTS

| | | | |
|---|---|---|---|
| 1,973,440 | 9/1934 | Meyncke | 118/408 X |
| 2,426,969 | 9/1947 | Hallowell, Jr. | 118/408 |
| 3,601,291 | 8/1971 | Tessmer | 118/408 X |
| 3,889,628 | 6/1975 | Usab | 118/408 X |

*Primary Examiner*—John P. McIntosh

*Attorney, Agent, or Firm*—Leonard J. Janowski

[57] ABSTRACT

A liquid dispensing apparatus is arranged to dispense a metered quantity of a liquid adhesive to form a uniform annular bead around an inside peripheral surface of a tube.

6 Claims, 4 Drawing Figures

LIQUID DISPENSING APPARATUS

BACKGROUND OF THE INVENTION

1. Field of the Invention

This invention relates generally to liquid dispensing apparatus, and more particularly to apparatus for dispensing liquid adhesive.

2. Description of the Prior Art

Known apparatus for dispensing a liquid adhesive for holding a plug in place inside a hollow, gas containing tube have included a reservoir having an open end and means for forcing the liquid adhesive past the open end. Typically, the open end of the reservoir is inserted into an end of the hollow tube and either the tube or reservoir is rotated as the liquid is being poured out to form an annular adhesive bead around an inside peripheral surface of the tube. The plug is then pushed into the open tube end where it is held in place by the adhesive. The adhesive and plug serve as a seal preventing the gas from escaping from the tube. Unfortunately, there is a tendency for known apparatus to dispense an unmetered amount of the adhesive to form a non-uniform annular adhesive bead that might present voids between the plug and tube inner wall. In addition, the manner of dispensing the adhesive permits the adhesive to flow onto an outside surface of the tube. Sometimes the gas in the tube escapes past the plug through the voids, and the adhesive on an outside tube surface manages to interfere with further handling of the tube.

Accordingly, it is desired to arrange an apparatus to dispense a metered quantity of liquid adhesive uniformly on a preferred surface of an article.

SUMMARY OF THE INVENTION

Apparatus for dispensing a metered quantity of a viscous liquid compresses a reservoir having coaxial apertures on opposing faces, a housing having a chamber, and a hollow piston disposed within the chamber. A rod is slidingly disposed within the piston to form a cavity between an end of the piston and an end of the rod for containing a metered quantity of the liquid. Means are attached to the housing for reciprocally moving the piston relative to the rod in opposite directions to open the cavity to receive the liquid, and to close the cavity to dispense the liquid. Means are attached to the rod for sliding the piston and rod in and out of the apertures in the reservoir.

DESCRIPTION OF THE PREFERRED EMBODIMENT

Figures 1, 2, 3:
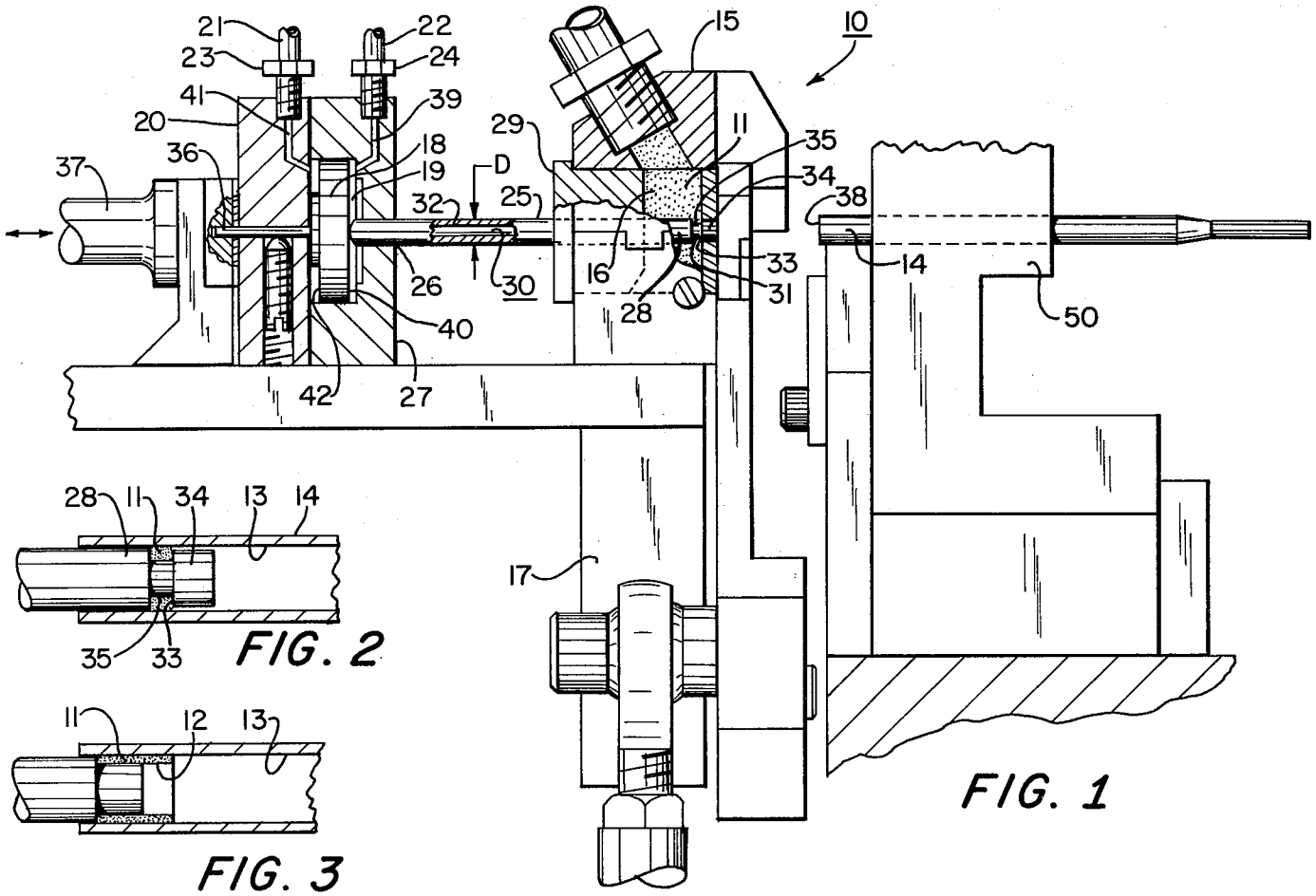
FIG. 1 is a partially sectioned side view of a liquid dispensing apparatus arranged according to the invention.
FIGS. 2 and 3 are partially sectioned side views of the apparatus shown in FIG. 1 dispensing liquid on an inside surface of a tube.

Referring to FIG. 1, there is shown a partially sectioned side view of apparatus 10 for dispensing a metered quantity of a viscous liquid adhesive 11 in a continuous ring 12 (FIG. 3) of substantially uniform depth and width around an inside surface 13 of a tube 14. The apparatus 10 includes a tubular housing 15 having a reservoir 16 for the liquid adhesive 11 fixedly mounted on a planar support member 17, and a hollow piston 18. The hollow piston 18 in the form of a tubular metal cylinder is disposed within a chamber 19 inside another tubular housing 20, and is adapted to be reciprocally moved along a linear path by fluid pressure periodically supplied to selected portions of the chamber 19. Means for supplying the fluid pressure includes first 21 and second 22 air lines connecting a source of compressed air, not shown, to nozzles 23,24 attached to the tubular housing 20.

The piston 18 has a smaller diameter tubular extension 25 that projects through an orifice 26 in a wall 27 of the housing 20 and the reservoir 16 in the form of a bushing 29 having a passageway for receiving the tubular extension 25 and an intersecting cavity for containing the liquid adhesive 11. The relative dimensions of the bushing openings and the outside diameter D of the tubular extension 25 are selected to permit the tubular extension 25 to freely slide in and out of the reservoir 16 while in friction contact with an internal wall of the bushing 29.

Means for receiving and dispensing a metered amount of the liquid adhesive 11 is coupled to an end 28 of the extension 25. An example of the liquid receiving and dispensing means include a cylindrical rod 30 having an end 31 of a first section 32 abruptly joined to a wall 33 of a larger diameter second section 34. The first section 32 is slidingly disposed within the piston extension 25 so that an annular cavity 35 may be formed between the end 28 of the extension 25 and the wall 33 of the second section 34. An opposite end 36 of the rod first section 32 passes through the piston 18 and is attached to an end 37 of a suitable crank driven by a motor, not shown, to reciprocally move the rod 30 and piston 18 along a linear path in and out of the reservoir 16.

Under operating conditions, the tube 14 is secured in a vise 50 with an open end 38 adjacent and substantially coaxial with the second section 34 of the rod 30. The crank end 37 and rod 30 are moved rearwardly away from the open tube end 38, until the wall 33 of the rod second section 34 and the end 28 of the tubular extension 25 are contiguous and within the reservoir 16. Compressed air in the second air line 22 is directed by the second nozzle 24 and associated channel 39 into the housing chamber 19 against a first face 40 of the piston 18. The compressed air causes the piston 18 to move rearwardly while the rod second section 34 remains stationary to expose the cavity 35 in the reservoir 16 for filling by the liquid 11. The housing 20 and rod end 36 are slidably moved forwardly by the motor driven crank end 37 until the liquid filled cavity 35 passes through the bushing 29 and into the open tube end 38. The movement of the liquid filled cavity 35 continues until the second rod section 34, the cavity 35 and a portion of the tubular extension 25 are inserted a predetermined distance into the open tube end 38, as shown in FIG. 2. The friction fit between the bushing 29 and external surfaces of the rod second section 34 and tubular extension 25 causes excess liquid to be squeezed off to leave a metered quantity of liquid 11 in the cavity 35. The quantity of liquid 11 dispensed at any time is determined by the volume of the cavity 35.

Compressed air in the first air line 21 is directed by the first nozzle 23 and associated channel 41 into the housing chamber 19 against a second face 42 of the piston 18. The compressed air causes the piston 18 to slideably move forwardly while the rod second section 34 remains stationary until the liquid 11 is squeezed from the cavity 35 against an inside peripheral surface 13 of the tube 14. The housing 20 and the rod end 36 are slidably moved rearwardly by the motor driven crank end 37 to pull the second section 34 of the rod 30 and tubular extension 25 from the tube 14. The movement of the rod 30 and extension 25 from the tube 14 causes the liquid 11 to be smeared to a substantially uniform depth in a ring 12 substantially without voids around the inside peripheral surface of the tube 14, as shown in FIG. 3. The depth of the deposited liquid is substantially equal to the difference between the inside diameter of the tube 14 and the outside diameter of the rod second section 34 and tubular extension 25. The width of the ring 12 is substantially determined by the volume of the cavity 35 and the depth of the deposited liquid 11.

Figure 4:
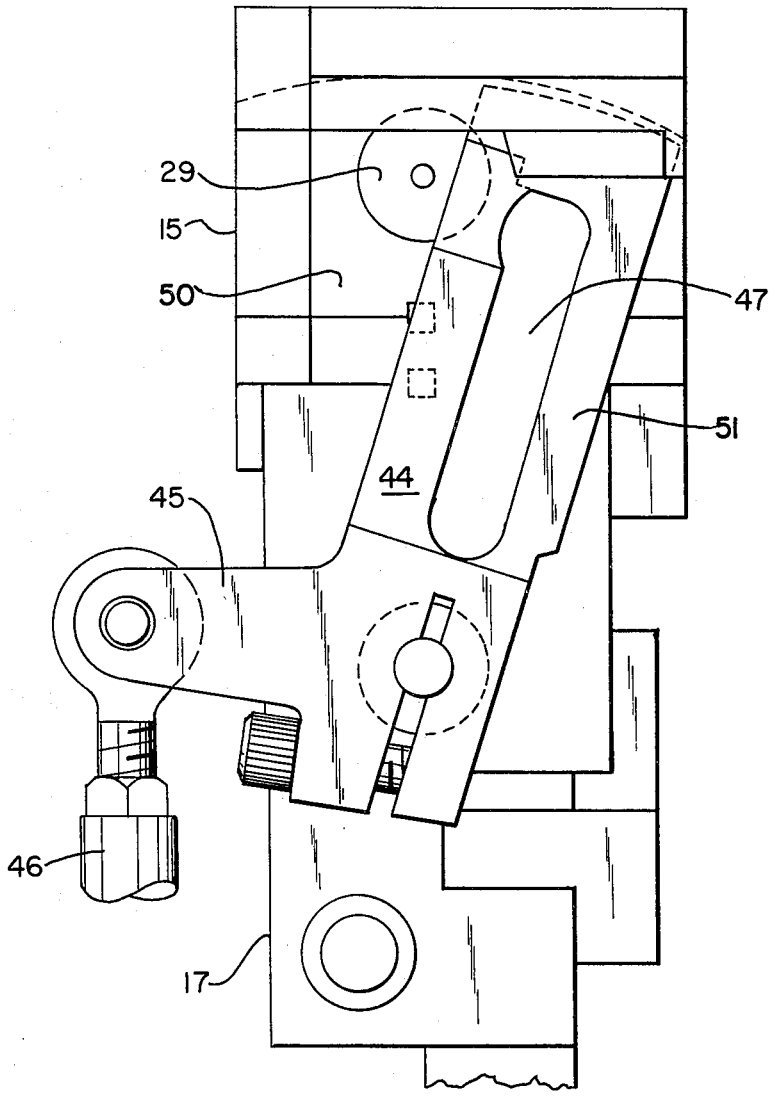
FIG. 4 is a front view of the apparatus shown in FIG. 1.

Referring to FIG. 4, there is shown a front view of the apparatus 10. A cleaning member 44 attached to the support member 17 to pivotally move across and against an exposed surface of the bushing 29 and reservoir face 50 opposite the open tube end 38 in response to a force applied against member end 45 by an end 46 of a known motor driven crank. The cleaning member 44 is intended to wipe and collect excess liquid 11 carried outside the reservoir 16 by the moving rod 30 and tubular extension 25. In the preferred embodiment, the cleaning member 44 is in the form of an arm 51 having a cavity 47 suitably arranged to collect the excess liquid 11 as the arm 51 is moved against and across the surfaces of the bushing 29 and reservoir face 50.

One embodiment of the invention has been shown and described by way of example only. Various other embodiments and modifications thereof will be apparent to those skilled in the art, and will fall within the scope of the invention as defined in the following claims.

What is claimed is:

1. Apparatus for dispensing a metered quantity of a viscous liquid comprising:

a reservoir having coaxial apertures on opposing faces;

a housing having a chamber;

a hollow piston being disposed within said chamber;

a rod being slidingly disposed within said piston to form a cavity between an end of said piston and an end of said rod for containing a metered quantity of said liquid;

means attached to said housing for reciprocally moving said piston relative to said rod in opposite directions to open said cavity to receive said liquid, and to close said cavity to dispense said liquid; and means attached to said rod for sliding said piston and rod in and out of said apertures in said reservoir.

2. Apparatus according to claim 1, wherein said means for reciprocally moving said piston relative to said rod include first nozzle means attached to said housing for supplying compressed gas from a source against one side of said piston in said chamber and second nozzle means attached to said housing for supplying said compressed gas from said source against an opposite side of said piston in said chamber.

3. Apparatus according to claim 1, wherein said cavity is annular.

4. Apparatus according to claim 1, wherein said rod has first and second sections, said first rod section having an outside diameter smaller than an outside diameter of said second rod section.

5. Apparatus according to claim 1, further including means for wiping and collecting said liquid from one of said faces of said reservoir.

6. Apparatus according to claim 1, further including bushings assembled in said apertures in said reservoir with a passageway for receiving said piston and rod and an intersecting cavity for containing said liquid.

* * * * *